US008445069B2

(12) United States Patent
Hayashi et al.

(10) Patent No.: US 8,445,069 B2
(45) Date of Patent: May 21, 2013

(54) COATING METHOD, COATER, AND METHOD FOR MANUFACTURING PLANOGRAPHIC PRINTING PLATE

(75) Inventors: Kenji Hayashi, Shizuoka (JP); Manabu Hashigaya, Shizuoka (JP); Keisuke Arimura, Shizuoka (JP); Go Nishino, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 494 days.

(21) Appl. No.: 12/750,238

(22) Filed: Mar. 30, 2010

(65) Prior Publication Data

US 2010/0247759 A1 Sep. 30, 2010

(30) Foreign Application Priority Data

Mar. 31, 2009 (JP) ..... 2009-084734

(51) Int. Cl.
*B05D 3/02* (2006.01)

(52) U.S. Cl.
USPC ..... 427/375; 427/374.1; 427/379; 427/402

(58) Field of Classification Search
None
See application file for complete search history.

(56) References Cited

U.S. PATENT DOCUMENTS

| | | | | |
|---|---|---|---|---|
| 4,845,008 | A | 7/1989 | Nishioka et al. | |
| 4,921,729 | A | 5/1990 | Kaneko et al. | |
| 6,497,926 | B1 | 12/2002 | Yokota et al. | |
| 2002/0098288 | A1 * | 7/2002 | Kamitani | 427/374.1 |
| 2005/0005794 | A1 | 1/2005 | Inukai et al. | |
| 2006/0230962 | A1 * | 10/2006 | Inukai et al. | 101/401.1 |
| 2007/0243344 | A1 | 10/2007 | Kito | |

FOREIGN PATENT DOCUMENTS

| | | | |
|---|---|---|---|
| JP | 62-251739 | A | 11/1987 |
| JP | 63-91171 | A | 4/1988 |
| JP | 6-242597 | A | 9/1994 |
| JP | 2001-113226 | A | 4/2001 |
| JP | 2002-49121 | A | 2/2002 |
| JP | 2004-358383 | A | 12/2004 |
| JP | 2005-334705 | A | 12/2005 |
| JP | 2007-260570 | A | 10/2007 |

OTHER PUBLICATIONS

Japanese Office Action dated Jun. 28, 2012, for Japanese Application No. 2009-084734, with English translation.

(Continued)

*Primary Examiner* — Timothy Meeks
*Assistant Examiner* — Michael P Rodriguez
(74) *Attorney, Agent, or Firm* — Birch, Stewart, Kolasch & Birch, LLP

(57) ABSTRACT

A coating method of forming a plurality of layers on a belt-like support continuously traveling, comprising:

a step of applying a first coating liquid onto a front surface of the support to form a lower layer on the support;

a drying step of removing a solvent in the lower layer until an amount of the residual solvent reaches not more than 100 mg/m$^2$;

a step of applying a second coating liquid onto the lower layer after drying to form an upper layer; and a drying step of removing moisture of the upper layer; wherein the drying step of removing moisture of the upper layer comprises:

a first drying step of removing moisture in the upper layer until a moisture content of the upper layer reaches not more than 10% of moisture at the time of application within a range in which a following conditional expression (1) is satisfied: (1) temperature (Tw) of the support≦average softening temperature (T0) of the lower layer+10° C.; and a second drying step of raising the temperature (Tw) of the support to remove remaining moisture of the upper layer.

10 Claims, 4 Drawing Sheets

OTHER PUBLICATIONS

Extended European Search Report for European Application No. 10158553.7 dated Jul. 26, 2010.

Official Communication pursuant to Article 94(3) EPC for European Application No. 10158553.7 dated Jul. 5, 2012.

* cited by examiner

FIG.4

| | KIND OF PHOTOSENSITIVE LAYER | HIGHEST SUPPORT TEMPERATURE UNTIL DRYING POINT | AVERAGE SOFTENING TEMPERATURE OF ADJACENT LOWER LAYER (T0) | DRYING TEMPERATURE OF DRYING AIR ON FRONT SURFACE SIDE (deg.) | AIR VELOCITY OF DRYING AIR ON FRONT SURFACE SIDE (m/s) | TIME FROM APPLICATION TO DRYING POINT (sec) | PRINTING PERFORMANCE EVALUATION | RELATIONSHIP BETWEEN SUPPORT TEMPERATURE AND TIME |
|---|---|---|---|---|---|---|---|---|
| EXAMPLE 1 | A | 35 | 53 | 35 | 1 | 1000 | EXCELLENT | PATTERN D |
| EXAMPLE 2 | A | 45 | 53 | 120 | 3 | 25 | EXCELLENT | PATTERN C |
| EXAMPLE 3 | A | 55 | 53 | 160 | 7 | 15 | EXCELLENT | PATTERN B |
| EXAMPLE 4 | A | 62 | 53 | 160 | 5 | 20 | GOOD | PATTERN E |
| COMPARATIVE EXAMPLE 1 | A | 70 | 53 | 160 | 4 | 23 | POOR | PATTERN A |
| COMPARATIVE EXAMPLE 2 | A | 80 | 53 | 125 | 1 | 70 | POOR | PATTERN F |
| EXAMPLE 5 | B | 35 | 46.25 | 35 | 1 | 1000 | EXCELLENT | PATTERN D |
| EXAMPLE 6 | B | 45 | 46.25 | 120 | 3 | 25 | EXCELLENT | PATTERN C |
| EXAMPLE 7 | B | 55 | 46.25 | 160 | 7 | 15 | EXCELLENT | PATTERN B |
| COMPARATIVE EXAMPLE 3 | B | 70 | 46.25 | 160 | 4 | 23 | POOR | PATTERN A |
| COMPARATIVE EXAMPLE 4 | B | 80 | 46.25 | 125 | 1 | 70 | POOR | PATTERN E |

COATING METHOD, COATER, AND METHOD FOR MANUFACTURING PLANOGRAPHIC PRINTING PLATE

BACKGROUND OF THE INVENTION

1. Field of the Invention

The present invention relates to a coating method, a coater, and a method for manufacturing a planographic printing plate, and particularly relates to a coating method for applying a plurality of coating liquids onto a support in layers, a coater, and a method for manufacturing a planographic printing plate.

2. Description of the Related Art

In recent years, techniques to give various kinds of functions to a support by applying a plurality of coating liquids onto the support continuously traveling to form a multilayer film have been widely used. In the techniques to form such a multilayer film, it is necessary to prevent unintended generation of inter-layer mixing in the coating liquids applied in layers.

Conventionally, various kinds of proposals have been made as this kind of the technique. Japanese Patent Application Laid-Open No. 2005-334705 has described a method in which a plurality of components that increase viscosity of a coating liquid when the coating liquids simultaneously applied contact each other or mix with each other are added to one of the coating liquids simultaneously applied, thereby to prevent generation of inter-layer mixing. This method needs a set zone device for adding the components, which are essentially unnecessary, to increase the viscosity.

Japanese Patent Application Laid-Open No. 2002-049121 has described a method for coating a heat developing photosensitive material. According to the method, drying as soon as possible after stratified coating is preferable, and it is preferable to proceed to a drying step within 10 seconds in order to avoid inter-layer mixing attributed to flow, diffusion, density difference, and the like. Moreover, Japanese Patent Application Laid-Open No. 2001-113226 has described a method for manufacturing an information recording material formed by laminating at least two or more layers on a support. In the method, curtain coating of a coating layer consisting of multiple layers of coating liquid layers is performed on a part or all of the layers that form the information recording material, and the coating layer is dried within 2 minutes after coating. In these methods, it is necessary to arrange a coater close to a dryer since the time until it proceeds to the drying step is limited. For that reason, flexibility is limited with respect to arrangement of each apparatus in a manufacturing line.

SUMMARY OF THE INVENTION

In coating of a planographic printing plate in which two or more layers of the coating layers are formed on a support continuously traveling, there is a case where two adjacent layers are successively subjected to stratified coating by which an upper layer is coated on a lower layer already coated and dried to become a dry layer. In such a case, when the upper layer is dried at an excessively high temperature, the lower layer already dried softens. This may cause unintended inter-layer mixing between components of the lower layer and those of the upper layer. Particularly, even when the components of the lower layer coating layer (resin, etc.) have very low solubility to the solvent of the upper layer, inter-layer mixing due to invasion of a material included in the upper layer into the lower layer may be generated depending on the temperature of the coating layer in drying, thereby deteriorating printing performance of the planographic printing plate.

The present invention has been made in consideration of such circumstances. An object of the present invention is to provide a coating method, a coater, and a method for manufacturing a planographic printing plate in which unintended inter-layer mixing is not generated even when drying an upper layer coated on a dried lower layer.

In order to attain the object, a coating method according to the present invention is a coating method of forming a plurality of layers on a band-like support continuously traveling, the method including: a step of applying a first coating liquid onto a front surface of the support to form a lower layer on the support; a drying step of removing a solvent in the lower layer until the amount of the residual solvent reaches not more than 100 mg/m$^2$; a step of applying a second coating liquid onto the lower layer after drying to form an upper layer; and a drying step of removing moisture of the upper layer; wherein the drying step of removing moisture of the upper layer includes: a first drying step of removing moisture in the upper layer until a moisture content of the upper layer reaches not more than 10% of a moisture at the time of application within a range in which the following conditional expression (1) is satisfied: (1) temperature (Tw) of the support≦average softening temperature (T0) of the lower layer+10° C.; and a second drying step of raising the temperature (Tw) of the support to remove the remaining moisture of the upper layer.

In order to attain the object, a coater according to the present invention is a coater that forms a plurality of layers on a belt-like support continuously traveling, the coater including: a first coater that applies a first coating liquid onto a front surface of the support to form a lower layer on the support; a first dryer that is disposed downstream of the first coater and removes a solvent in the lower layer until the amount of the residual solvent reaches not more than 100 mg/m$^2$; a second coater that is disposed downstream of the first dryer, and applies a second coating liquid onto the lower layer to form an upper layer; and a second dryer that is disposed downstream of the second coater and removes moisture of the upper layer; wherein the second dryer for the upper layer includes: a first drying part that removes moisture in the upper layer until an amount of moisture contained in the upper layer reaches not more than 10% of the moisture at the time of application within the range in which the following conditional expression (1) is satisfied: (1) temperature of the support (Tw) ≦average softening temperature (T0) of the lower layer+10° C.; and a second drying part that raises a temperature (Tw) of the support to remove the remaining moisture of the upper layer.

The present inventors have carefully observed a coating method in which adjacent two layers on a support are formed by applying an upper layer onto a lower layer, which is already coated and dried to become a dry layer. When temperature is raised only in consideration of drying of the upper layer, a temperature of the lower layer rises to not less than a predetermined temperature so that the lower layer may be softer. It was found out that, as a result, inter-layer mixing is generated due to invasion of a part of materials included in the upper layer into the lower layer.

Then, as a result of wholehearted research, the present inventors have discovered that unintended inter-layer mixing is prevented by removing moisture in the upper layer until an amount of moisture contained in the upper layer reaches not more than 10% of that at the time of application (drying point) within the range in which the following conditional expression (1) is satisfied: (1) temperature (Tw) of the support≦average softening temperature of the lower layer (T0)+10° C.; and subsequently raising the temperature (Tw) of the support to remove the remaining moisture of the upper layer. Thus, the present invention has been made.

Here, the average softening temperature (T0) of the lower layer means a temperature calculated by the following formula on the basis of composition included in the lower layer:

$$T0=((Bn\times Tgn+B(n-1)\times Tg(n-1)+B(n-2)\times Tg(n-2)\ldots+B1\times Tg1)+(Mn\times Tmn+M(n-1)\times Tm(n-1)+M(n-2)\times Tm(n-2)\ldots+M1\times Tm1)/((Bn+B(n-1)+B(n-2)+\ldots B1)+(Mn+M(n-1)+M(n-2)\ldots+M1))$$

(wherein Bn, B(n−1) . . . B1: weight of a binder per unit area included in the lower layer [g/m$^2$]; Tgn, Tg(n−1) . . . Tg1: glass transition point of each binder included in the lower layer (° C.); Mn, M(n−1) . . . M1: weight of a monomer per unit area included in the lower layer [g/m$^2$]; Tmn, Tm(n−1) . . . Tm1: melting point of each monomer included in lower layer (° C.); Tmn=0 when Tmn≦0° C.)

In one aspect of the coating method according to the present invention, preferably, the support is heated on both the front and rear surfaces thereof in the second drying step, thereby to raise the temperature (Tw) of the support to a temperature of not less than the average softening temperature of the lower layer (T0)+10° C. and remove the remaining moisture of the upper layer.

The remaining moisture can be removed in a short time since the support is heated on both the front and rear surfaces thereof so that the temperature (Tw) of the support may be not less than the average softening temperature of the lower layer (T0)+10° C.

In one aspect of the coating method according to the present invention, in the first drying step, preferably, the support is heated on both the front and rear surfaces thereof until the temperature (Tw) of the support reaches the average softening temperature (T0) of the lower layer−10° C. to +10° C., and subsequently the front surface of the support is heated while heating on the rear surface thereof is controlled.

In one aspect of the coating method according to the present invention, in the first drying step, preferably, the support is heated on both the front and rear surfaces thereof until the temperature (Tw) of the support reaches the average softening temperature (T0) of the lower layer−10° C. to +10° C., and subsequently the front surface of the support is heated while the rear surface thereof is cooled.

After the temperature (Tw) of the support reaches the average softening temperature (T0) of the lower layer−10° C. to +10° C., heating on the rear surface of the support is controlled, or cooling on the rear surface thereof is performed. Thereby, it is possible to prevent the temperature (Tw) of the support from exceeding the average softening temperature (T0) of the lower layer+10° C. Particularly when the temperature of the support is rapidly raised at an early stage, the temperature thereof cannot be maintained in desired temperature conditions, and may exceed the average softening temperature (T0) of the lower layer+10° C. In order to avoid this, it is preferable to provide a temperature control device or a cooling device.

In one aspect of a coater according to the present invention, the second dryer preferably includes: a first drying zone including a device for managing the temperature of the support and a device for raising the temperature of both surfaces of the support within the first drying unit, a second drying zone disposed downstream of the first drying zone and including a device for managing the temperature of the support, a device for heating the front surface of the support, and a device for controlling the temperature of the rear surface of the support or cooling the rear surface of the support within the first drying unit; and a third drying zone including a device for raising the temperature of the both surfaces of the support within the second drying unit.

By drying with the dryer including a plurality of drying zones, the temperature at the time of drying the upper layer can be controlled with better accuracy. Particularly when the second dryer includes the first drying zone including the device for managing the temperature of the support and the device for raising the temperature of both surfaces of the support; the second drying zone including the device for managing the temperature of the support, the device for heating the front surface of the support, and the device for controlling the temperature of the rear surface of the support or cooling the rear surface thereof; and the third drying zone including the device for raising the temperature of both surfaces of the support, the temperature can be controlled with accuracy and productivity can be improved.

In order to attain the object, a method for manufacturing a planographic printing plate according to the present invention is a method for manufacturing a planographic printing plate having a photosensitive layer and a protective layer in this order on a support, wherein the photosensitive layer is applied as a lower layer and the protective layer is applied as an upper layer with one of the coating methods.

By applying the above-mentioned coating method to the method for manufacturing a planographic printing plate, unintended inter-layer mixing can be prevented and deterioration in printing performance of the planographic printing plate can be prevented.

According to the coating method and the coater according to the present invention, unintended inter-layer mixing can be prevented even when the upper layer applied onto the dried lower layer is dried.

Further, according to the method for manufacturing a planographic printing plate according to the present invention, deterioration in printing performance of the planographic printing plate can be prevented.

BRIEF DESCRIPTION OF THE DRAWINGS

FIG. 4 is a table showing results of Examples.

DETAILED DESCRIPTION OF THE PREFERRED EMBODIMENTS

Hereinafter, preferable embodiments according to the present invention will be described in accordance with the accompanying drawings. While the present invention will be described by the following preferable embodiment, modifications can be made with a lot of methods without deviating from the scope of the present invention, and other embodiments other than the present embodiment can also be used. Accordingly, all the modifications of the present invention within the scope of the present invention are included in the scope of claims. Additionally, herein, a range of numeral values expressed using "to" includes the numeral values described before and after "to."

Hereinafter, description will be given of an example in which a coating method according to the present invention is incorporated into manufacturing of a planographic printing plate. However, the present invention will not be limited to incorporation to manufacturing of the planographic printing plate, and can be incorporated into various kinds of production lines.

The present invention demonstrates a significant effect particularly when a lower layer already dried is a system including a monomer and a binder and is hard to dissolve in water, and further when an upper layer includes a dispersing object, and the dispersing object has a specific gravity larger than 1.5 and has a particle size (outer diameter) of not more than 10 μm.

The layer that is hard to dissolve in water designates a layer having properties that an amount of not more than 30% the layer (lower layer) is eluted to 60° C. hot water obtained by warming pure water.

For example, when the lower layer is a layer that easily dissolves into water, mixing is caused by contacting of the lower layer and water. Therefore, quick removal of water (solvent) is essential to prevention of inter-layer mixing. On the other hand, in the case of the layer that is hard to dissolve into water, the layer is hardly influenced by contact time with the solvent, and only temperature is a dominant factor with respect to inter-layer mixing. The present invention herein has a significant effect on such a system.

When the specific gravity of the dispersing object is not more than 1.5, the dispersing object of the upper layer also approaches the lower layer side by heating convection. However, the amount is small, and therefore less inter-layer mixing is generated. On the other hand, when the specific gravity of the dispersing object is larger than 1.5, more amount of the dispersing object sinks into the lower layer side. For that reason, inter-layer mixing is accelerated.

Moreover, when the dispersing object has a small particle size of not more than 10 μm, unexpected mixing takes place easilier irrespective of the shape of the dispersing object.

Figure 1:
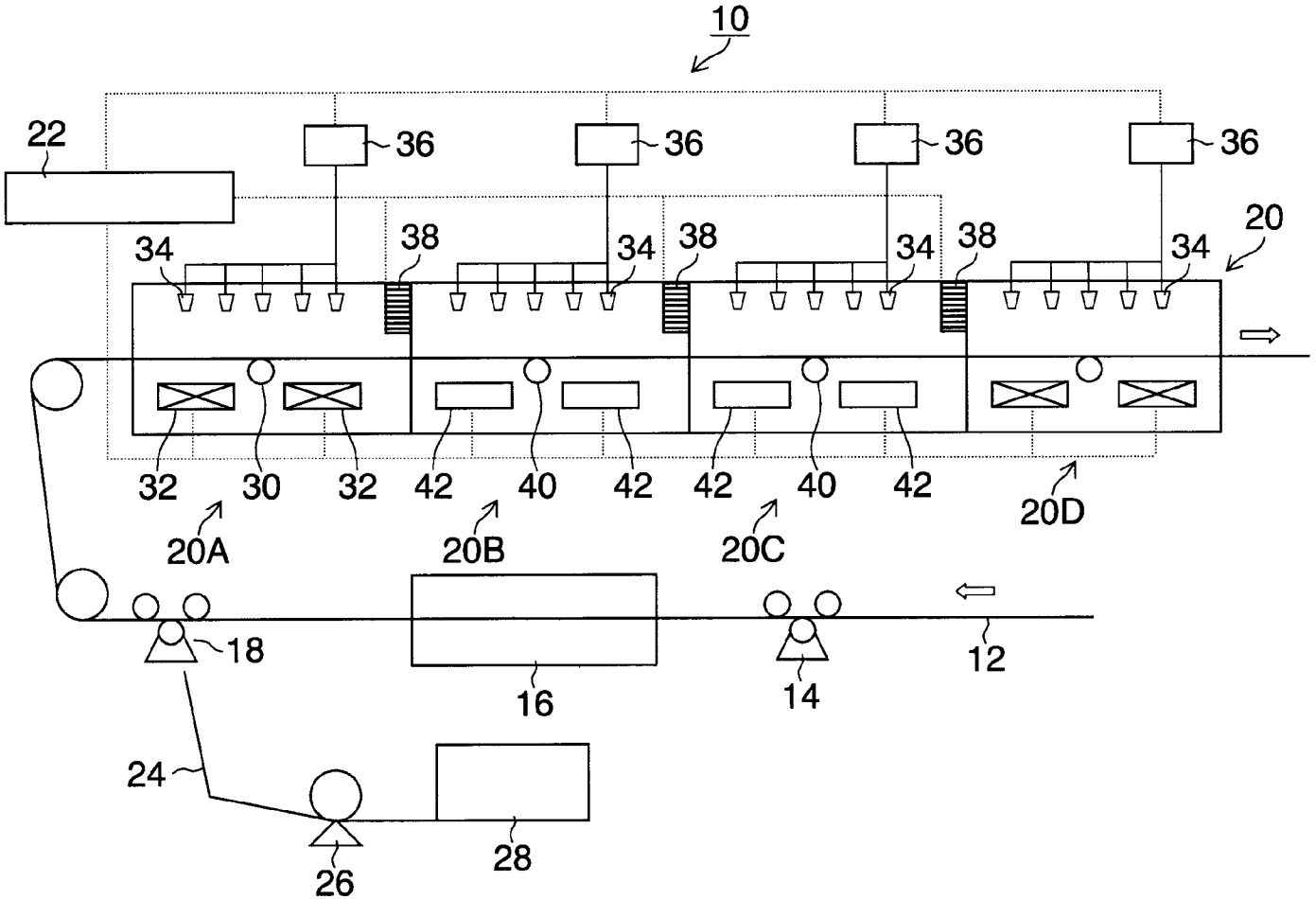
FIG. 1 is a configuration diagram showing a manufacturing line of a planographic printing plate.

FIG. 1 is a configuration diagram showing an example of a production line 10 for a planographic printing plate. As shown in FIG. 1, the production line 10 for a planographic printing plate includes a first coater 14 that applies a photosensitive layer formation liquid onto a support 12 continuously traveling to form a photosensitive layer (lower layer), for example; a first dryer 16 that is disposed downstream of the first coater 14 and dries the lower layer so as to have a predetermined amount of moisture; a second coater 18 that is disposed downstream of the first dryer 16 and applies a protective layer formation liquid to form a protective layer (upper layer), for example; a second dryer 20 that is disposed downstream of the second coater and dries the upper layer; and a temperature selector 22 that controls drying conditions of the second dryer 20.

As the support 12 used for the present invention, aluminum having dimensional stability or aluminum alloys (for example, aluminum silicon alloys, aluminum copper alloys, aluminum manganese alloys, aluminum magnesium alloys, aluminum chromium alloys, aluminum zinc alloys, aluminum lead alloys, aluminum bismuth alloys, aluminum nickel alloys) can be used. Generally, conventionally known materials of described in Aruminiumu Handobukku fourth edition (1990, published by Japan Light Metal Association), for example, a JIS A 1050 material, a JIS A 1100 material, a JIS A 3103 material, a JIS A 3004 material, and a JIS A 3005 material are used. Alternatively, alloys obtained by adding magnesium of not less than 0.1 wt % to these materials are used in order to increase tensile strength.

When the support 12 is an aluminum plate, various processing is usually performed on the surface of the support in a surface treatment part depending on a purpose. As a general treatment method, degreasing or electrolytic polishing treatment and desmut treatment are first performed on the aluminum plate to clean the aluminum surface. Subsequently, a mechanical surface roughening process and/or an electrochemical surface roughening process are performed to give fine projections and depressions to the surface of the aluminum plate. A chemical etching process and desmut treatment may be additionally performed at this time. Subsequently, anodizing is performed to improve wear resistance of the aluminum plate surface. Then, the aluminum surface is subjected to hydrophilization treatment and/or sealing when necessary. However, the support may not be limited to these, and a complex material made of a metal and a resin may be used.

The first coater 14 applies the photosensitive layer formation liquid as a first coating liquid onto the support 12 continuously traveling to form the lower layer. A coating method is not limited in particular in the first coater 14. It is possible to use a coating apparatus in which a method of using a coating rod, a method of using an extrusion die coater, or a method of using a slide bead coater, etc. is used.

The photosensitive layer formation liquid for forming the photosensitive layer of the planographic printing plate can include a photosensitive solution that forms a photosensitive layer having aspects of (1) to (11) below.

(1) An aspect in which the photosensitive layer contains an infrared absorption agent, a compound that generates acid by heat, and a compound that becomes crosslinked by acid.

(2) An aspect in which the photosensitive layer contains an infrared absorption agent and a compound turned to have alkali solubility by heat.

(3) An aspect in which the photosensitive layer includes two layers: one is a layer containing a compound that generates radicals by irradiation with a laser beam, a binder soluble in alkali, and a polyfunctional monomer or a prepolymer, and the other is an oxygen shut off layer.

(4) An aspect in which the photosensitive layer is formed of two layers of a physical development nuclei layer and a silver halide emulsion layer.

(5) An aspect in which the photosensitive layer includes three layers of a polymerized layer containing a polyfunctional monomer and a polyfunctional binder, a layer containing silver halide and a reducing agent, and an oxygen shut off layer.

(6) An aspect in which the photosensitive layer includes two layers of a layer containing a novolak resin and naphthoquinonediazide and a layer containing silver halide.

(7) An aspect in which the photosensitive layer contains an organic photo conductor.

(8) An aspect in which the photosensitive layer includes two to three layers made of a laser beam absorption layer removed by irradiation with a laser beam, and an oleophilic layer and/or a hydrophilic layer.

(9) An aspect in which the photosensitive layer contains a compound that absorbs energy and generates acid, a polymer compound having a functional group that generates sulfonic acid or carboxylic acid by acid in a side chain, and a compound that gives energy to an acid generator by absorbing visible light.

(10) An aspect in which the photosensitive layer contains a quinone diazide compound and a novolak resin.

(11) An aspect in which the photosensitive layer contains a compound that decomposes by light or ultraviolet rays to form a crosslinked structure with the compound itself or other molecules within the layer, and a binder soluble in alkali.

However, the first coater and the first coating liquid are not limited to these.

As the first coating liquid, more specifically as a solvent that dissolves photopolymerizing type photosensitive composition, organic solvents described in Japanese Patent Application Laid-Open No. 62-251739 and Japanese Patent Application Laid-Open No. 06-242597 are used. The photopolymerizing type photosensitive composition is dissolved and dispersed in a solid content concentration of 2 to 50% by weight, and applied onto the support 12 and dried. Although an applied amount of a layer (photosensitive layer) of the photopolymerizing type photosensitive composition applied on the support 12 varies depending on applications, generally, 0.3 to 4.0 g/m$^2$ on a basis of a weight after drying is preferable. As the applied amount becomes smaller, an amount of light exposure for obtaining an image becomes smaller but strength of the layer reduces. As the applied amount becomes larger, more amount of light exposure is needed but the photosensitive layer becomes stronger. For example, when the photosensitive layer is used as a printing plate, a printing plate having the large number of sheets that can be printed (having high printing resistance) is obtained. A surfactant for improving quality of the coated surface, particularly preferably, a fluorochemical surfactant can be added to the photosensitive composition.

The photopolymerizing type photosensitive composition used for a planographic printing plate contains an ethylene unsaturated compound allowing addition polymerization, a photoinitiator, and a polymer binder as essential components. When necessary, various compounds such as a colorant, a plasticizer, and a thermal polymerization inhibitor can be used in combination. The ethylene unsaturated compound is a compound having ethylene unsaturated bonds addition polymerized by action of a photopolymerization initiator and crosslinked and hardened when the photopolymerizing type photosensitive composition receives irradiation of active light.

Subsequently, the solvent included in the lower layer formed on the support 12 is removed by the first dryer 16 until the amount of the residual solvent at least in a set-to-touch state reaches not more than 100 mg/m$^2$.

A drying method is not limited in the first dryer 16. It is possible to use a dryer that uses a method in which a pass roller is disposed within the dryer, and the support is wrapped around the pass roller and conveyed while hot air is sprayed to the support for drying; a method for drying while supplying air by nozzles from the upper and lower sides of the support to float the support; a method for drying by the radiant heat from heating plates arranged above and below a belt-like object; a method for passing a heating medium through a roll to heat the heating medium and drying by heat conduction caused when the roll contacts the support; or the like.

In any of the methods, in order to uniformly dry a belt-like object obtained by applying the coating liquid onto the support, the heating is controlled by changing kinds of the support or kinds of the coating liquid, the amount of the coating liquid applied, kinds of the solvent, and a flow rate of the hot air or the heating medium, the temperature thereof, and how to feed the hot air or the heating medium in accordance with a traveling speed or the like where relevant. Moreover, not less than two kinds of the drying methods may be used in combination.

Subsequently, the second coater 18 applies the protective layer formation liquid onto the lower layer dried until the lower layer has the predetermined amount of the solvent, thereby to form a protective layer. A coating method is not limited in particular in the second coater 18. It is possible to use a coating apparatus that uses a method of using a coating rod, a method of using an extrusion die coater or a method of using a slide bead coater, etc.

The second coater 18 is connected to a jacket tank 28 through a piping 24 and a pump 26. The jacket tank 28 stores a heating medium whose temperature is adjusted. This heating medium is supplied to the second coater 18 by the pump 26. The heating medium adjusts the temperature of the coating liquid in the second coater 18 to the range of the average softening temperature (T0) of the lower layer±10° C.

Before the second coating liquid is applied onto the lower layer, the second coating liquid is adjusted to the range of the average softening temperature (T0) of the lower layer±10° C. Accordingly, in the drying step of the upper layer, the temperature of the support 12 can be raised comparatively in a shorter time. Thus, productivity can be further improved. However, when the temperature of the second coating liquid is raised to a temperature exceeding the average softening temperature (T0) of the lower layer+10° C., application of the second coating liquid onto the lower layer may soften the lower layer. Then, it is preferable to adjust the temperature of the second coating liquid to the range of not more than the average softening temperature (T0) of the lower layer+10° C. as much as possible. From a viewpoint of quick raising of the temperature in the first half part of the dryer, the second coating liquid is desirably applied at a temperature of not less than the temperature of the support, and more desirably, applied at a temperature of not less than the average softening temperature (T0) of the lower layer−10° C.

The followings can be used as the protective layer formation liquid for forming the protective layer in the planographic printing plate.

The protective layer (PVA coating layer) that mainly contains a water soluble polymer including hydrogen bonding groups, for example, PVA (polyvinyl alcohol) is formed by the second coater 18.

The water soluble polymer including hydrogen bonding groups contained in the protective layer can include polyvinyl alcohols and partial esters of polyvinyl alcohols, ethers, and acetal, or copolymers of the above-mentioned water soluble polymers and unsubstituted vinyl alcohols containing a substantial amount of unsubstituted vinyl alcohol units that give water solubility necessary for the above-mentioned water soluble polymers. Polyvinyl alcohols can include polyvinyl alcohols that are 71 to 100% hydrolyzed and have a polymerization degree in the range of 300 to 2400. Specifically, PVA-105, PVA-110, PVA-117, PVA-117H, PVA-120, PVA-124, PVA-124H, PVA-CS, PVA-CST, PVA-HC, PVA-203, PVA-204, PVA-205, PVA-210, PVA-217, PVA-220, PVA-224, PVA-217EE, PVA-220, PVA-224, PVA-217EE, PVA-217E, PVA-220E, PVA-224E, PVA-405, PVA-420, PVA-613, and L-8 made by Kuraray Co., Ltd., etc. are included. The above-mentioned copolymers include polyvinyl acetate chloro acetate or propionate 88 to 100% hydrolyzed, polyvinyl formals, polyvinyl acetals, and copolymers of these. In addition, as other useful polymers, polyvinyl pyrrolidone, gelatin, and gum arabic are included, and these may be used alone or in combination. These water soluble polymers are contained in a proportion of 30 to 99%, and preferably in a proportion of 50 to 99% to the total solid content of the protective layer. The protective layer may be applied so as to form multiple layers when necessary.

Moreover, the protective layer may contain an inorganic layer compound. The inorganic layer compound is particles having a thin plate-like shape. For example, the inorganic layer compound can include mica groups represented by a general formula $A(B,C)_2\text{-}5D_4O_{10}(OH,F,O)_2$ such as natural mica (wherein A is either of K, Na, and Ca, B and C are either of Fe(II), Fe(III), Mn, Al, Mg, and V, and D is Si or Al.) and synthetic mica. The inorganic layer compound can also include talc represented by a general formula $3MgO.4SiO.H_2O$, tainiolite, montmorillonite, saponite, hectorite, zirconium phosphate.

These thin plate-like particles disperse in the binder so as to overlap each other, so that a thin layer made of the inorganic compound is formed in the binder mainly containing the PVA. It is thought, as a result, water resistance, oxygen shut off properties, and layer strength are further improved.

In the above-mentioned mica group, natural mica includes muscovite, paragonite, phlogopite, biotite, and lepidolite. Moreover, synthetic mica includes non-swelling mica such as fluorine phlogopite $KMg_3(AlSi_3O_{10})F_2$ and potassium 4 silicon mica $KMg_{2.5}(Si_4O_{10})F_2$; and swelling mica such as Na tetra cyrillic mica $NaMg_{2.5}(Si_4O_{10})F_2$, Na or Li tainiolite $(Na,Li)Mg_2Li(Si_4O_{10})F_2$, and montmorillonite Na or Li hectorite $(Na,Li)_{1/8}Mg_{2/5}Li_{1/8}(Si_4O_{10})F_2$. Synthetic smectite is also useful.

The amount of addition in a case of adding a protective layer made of a mica compound to the protective layer is preferably 1.0 to 30 mass % to the total solid content of the protective layer, and more preferably is the range of 2.0 to 20 mass %.

The protective layer may also contain organic resin particulates. Preferably, the organic resin particulates have high compatibility with the binder (for example, polyvinyl alcohol) in the protective layer, are kneaded well into the protective layer, and do not remove from the protective layer surface.

The organic resin particulates having the above-mentioned properties include poly(meth) acrylic esters; polystyrenes and the derivatives thereof; polyamides; polyimides; polyolefines such as low density polyethylenes, high density polyethylenes, and polypropylenes; copolymers of those polymers and povals; synthetic resin particles made of polyurethanes, polyureas, and polyesters; and natural polymer particulates made of chitin, chitosan, cellulose, crosslinking starch, crosslinking cellulose, and the like. Especially, the synthetic resin particles are advantageous in that it is easy to control the particle size, easy to control desired surface properties by surface modification, or the like.

As the organic resin particulates, organic resin particulates containing a silica component are preferable. Among them, silica coated particulates obtained by covering a part of the surface of the organic resin particulates with a silica layer are particularly preferable. By the presence of silica at least in a part of the surface of the organic resin particulates, the compatibility of the organic resin particulates with the binder (polyvinyl alcohol) can be improved. Further, removal of the organic resin particulates can be suppressed even when an external force is applied to the protective layer. Consequently, excellent damage resistance and adhesiveness resistance can be maintained.

The amount of addition when the protective layer contains the organic resin particulates (silica coated particulates) can be 5 to 1000 $mg/m^2$.

The upper layer will not be limited to the above-mentioned protective layer, and any protective layer may be used as long as it can be applied onto the lower layer formed on the support 12. Moreover, the upper layer may be a single layer or multilayer.

Next, the support 12 having the upper layer formed on the lower layer is conveyed to the second dryer 20. The support 12 is dried so as to have a desired amount of moisture by the second dryer 20, and conveyed out of the second dryer 20. A total time (t) of drying the upper layer is a period of time during which the support 12 is conveyed to the second dryer 20 and conveyed out thereof.

The second dryer 20 is divided into a plurality of drying zones 20A to 20D. The drying zone 20A is provided with a heating roller 30 and heating plates 32 disposed on both sides of the heating roller 30. The heating roller 30 and the heating plates 32 are provided on the rear surface side of the support 12. Moreover, a plurality of nozzles 34 that supply drying air to the front surface of the support 12 are provided in the drying zone 20A. The plurality of nozzles 34 are connected to a fan 36. Further, a temperature sensor 38 for measuring the temperature of the support 12 is provided in the drying zone 20A.

The drying zone 20B is provided with the nozzles 34 that supply drying air to the front surface side of the support 12 and the fan 36 in the same manner as in the case of the drying zone 20A. On the other hand, a cooling roller 40 and cooling plates 42 are provided on the rear surface side of the support 12 instead of the heating roller 30 and the heating plates 32. The temperature sensor 38 for measuring the temperature of the support 12 is provided in the drying zone 20B. The drying zone 20C has the same configuration as that of the drying zone 20B. The drying zone 20D has the same configuration as that of the drying zone 20A except that the temperature sensor 38 is not included.

As an alternative to the above-mentioned method, the temperature of the support 12 can be controlled by drying a coated surface while cooling the rear surface of the support by a floating drying method or latent heat of vaporization.

The plurality of temperature sensors 38 disposed in the drying zones 20A to 20C are electrically connected to a temperature selector 22, and temperature information on the drying zones 20A to 20C is transmitted to the temperature selector 22. The plurality of fans 36 installed in the drying zones 20A to 20D are connected to the temperature selector 22. On the basis of the temperature information from the temperature sensor 38, the temperature selector 22 controls the temperature and the amount of air in the plurality of fans 36. The plurality of heating plates 32 installed in the drying zones 20A and 20D and the plurality of cooling plates 42 installed in the drying zones 20B and 20C are connected to the temperature selector 22. On the basis of the temperature information from the temperature sensor 38, the temperature selector 22 controls the heating amount of the heating plate 32 and the cooling amount of the cooling plate 42.

In the coating method according to the present invention, the upper layer is applied onto the lower layer and dried, the solvent being removed from the lower layer until the amount of the residual solvent at least in a set-to-touch state reaches not more than 100 $mg/m^2$. Usually, it is recognized that no inter-layer mixing is generated even when the coating liquid is applied onto the lower layer in the set-to-touch state and the upper layer is applied onto the lower layer and dried.

However, unexpected inter-layer mixing such as invasion of a part of materials of the upper layer is generated when the temperature of the lower layer significantly exceeds the average softening temperature (T0) determined by the following formula in the drying step of the upper layer.

$$T0=((Bn\times Tgn+B(n-1)\times Tg(n-1)+B(n-2)\times Tg(n-2)\ldots+B1\times Tg1)+(Mn\times Tmn+M(n-1)\times Tm(n-1)+M(n-2)\times Tm(n-2)\ldots+M1\times Tm1)/((Bn+B(n-1)+B(n-2)+\ldots B1)+(Mn+M(n-1)+M(n-2)\ldots+M1))$$

(wherein Bn, B(n−1) . . . B1: weight of a binder per unit area included in the lower layer [$g/m^2$]; Tgn, Tg(n−1) . . . Tg1: glass transition point of each binder included in the lower layer (° C.); Mn, M(n−1). . . M1: weight of a monomer per unit area included in the lower layer [g/m$^2$]; Tmn, Tm(n−1) . . . Tm1: melting point of each monomer included in the lower layer (° C.); and Tmn=0 when Tmn≦0° C.)

Then, in the present invention, the following temperature control is applied in the drying step of the upper layer.

In other words, as one feature of the present invention, drying of the upper layer by the second dryer 20 includes the first drying step of removing moisture in the upper layer until the moisture content of the upper layer reaches not more than 10% of that at the time of application (drying point) within the range in which the conditional expression (1) is satisfied: (1) temperature of the support 12 (Tw)≦average softening temperature (T0) of the lower layer+10° C.; and the second drying step of raising the temperature (Tw) of the support 12 to remove moisture that remains in the upper layer.

In the present embodiment, the first drying step is performed in the drying zones 20A to 20C, and the second drying step is performed in the drying zone 20D.

First, the support 12 having the upper layer formed is conveyed to the drying zone 20A. The drying zone 20A measures approximately ¼ of the length of the second dryer 20. Therefore, the support 12 passes through the drying zone 20A in approximately ¼ of the total time (t). Within this drying zone 20A, the temperature (Tw) of the support 12 is rapidly heated so as to be the average softening temperature (T0) of the lower layer±10° C. For that purpose, within the drying zone 20A, hot air is supplied to the front surface of the support 12 from the nozzles 34, and the rear surface of the support 12 is heated by the heating roller 30 and the heating plates 32.

By rapidly heating the support 12 in the drying zone 20A measuring approximately ¼ of the length of the second dryer 20, the drying step of the upper layer can be terminated in a short time so that high productivity can be maintained. Here, an important point is to prevent the temperature (Tw) of the support 12 from exceeding the average softening temperature (T0) of the lower layer+10° C.

Subsequently, the support 12 is conveyed to the drying zones 20B and 20C. In the drying zones 20B and 20C, the support 12 is cooled by the cooling roller 40 and the cooling plates 42, thereby to control the temperature (Tw) of the support so as not to exceed the average softening temperature (T0) of the lower layer+10° C. In the present embodiment, temperature control can be performed with better accuracy by cooling on the rear surface of the support 12. However, the present invention will not be limited to this, and the temperature (Tw) of the support 12 may be controlled by installing a heating plate on the rear surface of the support and controlling the amount of heat applied from the heating plate.

When the support 12 is conveyed out of the drying zone 20C, moisture is removed in the upper layer until the moisture content of the upper layer reaches not more than 10% of that at the time of application of the upper layer (drying point). Even when the material included in the upper layer moves to the lower layer, the lower layer does not soften until the moisture content of the upper layer reaches not more than 10% (drying point). Accordingly, unintended inter-layer mixing caused by invasion of the material in the upper layer into the lower layer is prevented.

The drying point can be detected by a water content sensor, and can also be grasped on the basis of change in invasion of coated articles even with visual observation.

Subsequently, the support 12 is conveyed to the drying zone 20D. In the drying zone 20D, the front surface of the support 12 is heated by hot air from the nozzles 34, and the rear surface of the support 12 is heated by the heating roller 30 and the heating plates 32. Thereby, the temperature (Tw) of the support 12 rises. Thereby, the remaining moisture contained in the upper layer is removed. In the drying zone 20D, the temperature (Tw) of the support 12 is heated at a temperature of not less than the average softening temperature (T0) of the lower layer+10° C. The lower layer softens at this time. However, before the support 12 arrives at the drying zone 20D, moisture is already removed until the moisture content of the upper layer reaches not more than 10% of that at the time of application of the upper layer, and the upper layer is hardened. Accordingly, it is thought that movement of the material included in the upper layer into the lower layer is limited, and no unintended inter-layer mixing is generated even when the lower layer softens.

The remaining moisture of the support 12 is removed within the drying zone 20D, and the support 12 is conveyed to the outside of the drying zone 20D.

As mentioned above, detailed description has been given of the coating method, the coater, and the method for manufacturing a planographic printing plate according to the present invention. However, the present invention will not be limited to the above-mentioned embodiment, and various kinds of improvement and modifications may be made without deviating from the gist and scope of the present invention.

Examples

Hereinafter, specific examples according to the present invention will be given to describe the present invention in more detail. A planographic printing plate was produced using the production line 10 shown in FIG. 1.

[Production of a Support]

In the present Example, a support made of aluminum and having a width of 1000 mm and a thickness of 0.3 mm was used.

[Undercoat Layer]

Next, a coating liquid for an undercoat layer below was applied onto the surface of this aluminum support with a wire bar, and dried at 100° C. for 10 seconds. The amount of application was 10 mg/m$^2$.

(Coating Liquid for the Undercoat Layer)

| | |
|---|---|
| Polymer compound A having the following structure (weight average molecular weight: 10,000) | 0.05 g |
| Methanol | 27 g |

[Formula 1]

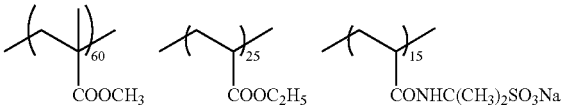

Polymer compound A

| | |
|---|---|
| Ion exchange water | 3 g |

[Photosensitive Layer Formation Liquid]

In accordance with the following photosensitive layer formation liquid composition, two kinds of photosensitive layer formation liquids A and B were prepared.

(Compositions of the Photosensitive Layer Formation Liquids)

solvent: methyl ethyl ketone, 1-methoxy-2-propanol binder 1 (B-1): Tg=100° C.

binder 2 (B-2): Tg=80° C.

monomer 1 (M-1): melting point=−30° C.

photosensitive layer A content ratio B1:B2:M1=1:2:2 photosensitive layer B content ratio B1:B2:M1=1:1:2 in addition, a surfactant, a dye, etc.

and Comparative Examples 3 and 4 include the photosensitive layer B formed as the lower layer.

In Example 1, only drying air having a comparatively low temperature was applied to the front surface of the support until the moisture content of the upper layer reached the drying point, and the upper layer was dried for a long time. In Example 2, the upper layer was dried from the upper surface of the support comparatively in a short time only using drying air having a moderate temperature until the moisture content of the upper layer reached the drying point. In Example 3, hot drying air was applied from the upper surface of the support until the moisture content of the upper layer reached the drying point, and cooled on the rear surface of the support to

[Formula 2]

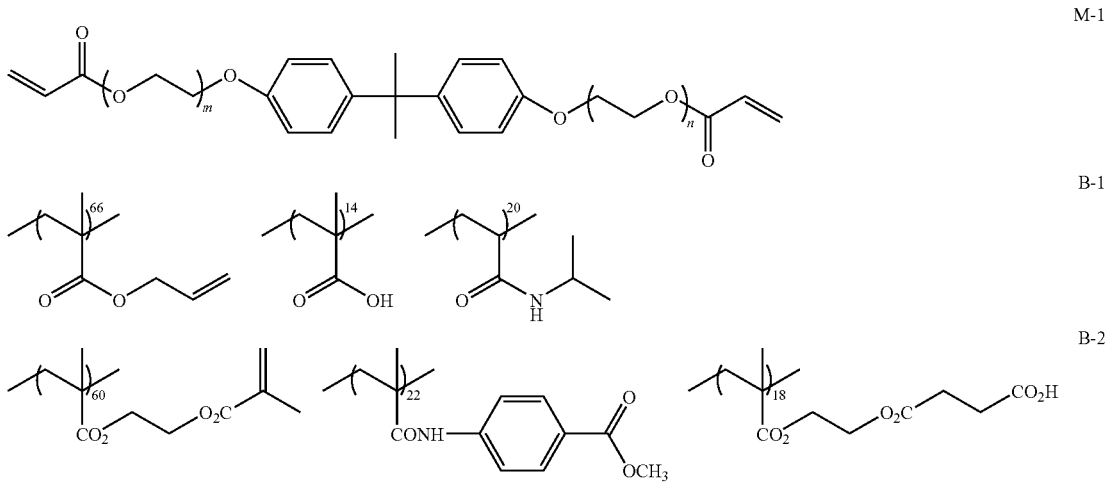

[Protective Layer Formation Liquid]

A protective layer formation liquid was prepared in accordance with the following protective layer formation liquid composition.

(Composition of the Protective Layer Formation Liquid)

solvent: water solute: polyvinyl alcohol (PVA); synthetic mica; surfactant A (made by Nihon Emulsion Co., Ltd., Emalex 710); surfactant B (ADEKA Pluronic P-84: made by ADEKA CORPORATION); organic filler (ART PEARL J-7P, made by Negami Chemical industrial Co., Ltd.); thickener (CELLOGEN FS-B, made by DAI-ICHI KOGYO SEIYAKU Co., Ltd.); and polymer compound A

[Formation of a Lower Layer and an Upper Layer]

The undercoat layer was formed on the support, and the photosensitive layer A was applied and dried so that the amount of the residual solvent might reach not more than 100 mg/m$^2$ and approximately 100 mg/m$^2$. Subsequently, the protective layer was applied as the upper layer. The undercoat layer was formed on the support, and the photosensitive layer B was applied and dried so that the amount of the residual solvent might reach not more than 100 mg/m$^2$ and approximately 100 mg/m$^2$. Subsequently, the protective layer was applied as the upper layer. The temperature at which the protective layer was applied was adjusted in the range of the average softening temperature of the lower layer (T0)±10° C.

A table in FIG. 4 summarizes drying conditions of the upper layer and evaluation results thereof. Examples 1 to 4 and Comparative Examples 1 and 2 include the photosensitive layer A formed as the lower layer, and Examples 5 to 7 dry the upper layer in a short time. In Example 4, until the moisture content of the upper layer reached the drying point, hot drying air was applied from the upper surface of the support, and the temperature was controlled from the rear surface of the support. The upper layer was dried in a short time. In Comparative Example 1, only hot drying air was applied from the upper surface of the support until the moisture content of the upper layer reached the drying point, and the upper layer was dried in a short time. In Comparative Example 2, only drying air having a moderate temperature was applied from the upper surface of the support until the moisture content of the upper layer reached the drying point, and the upper layer was dried in a short time.

Figure 2:
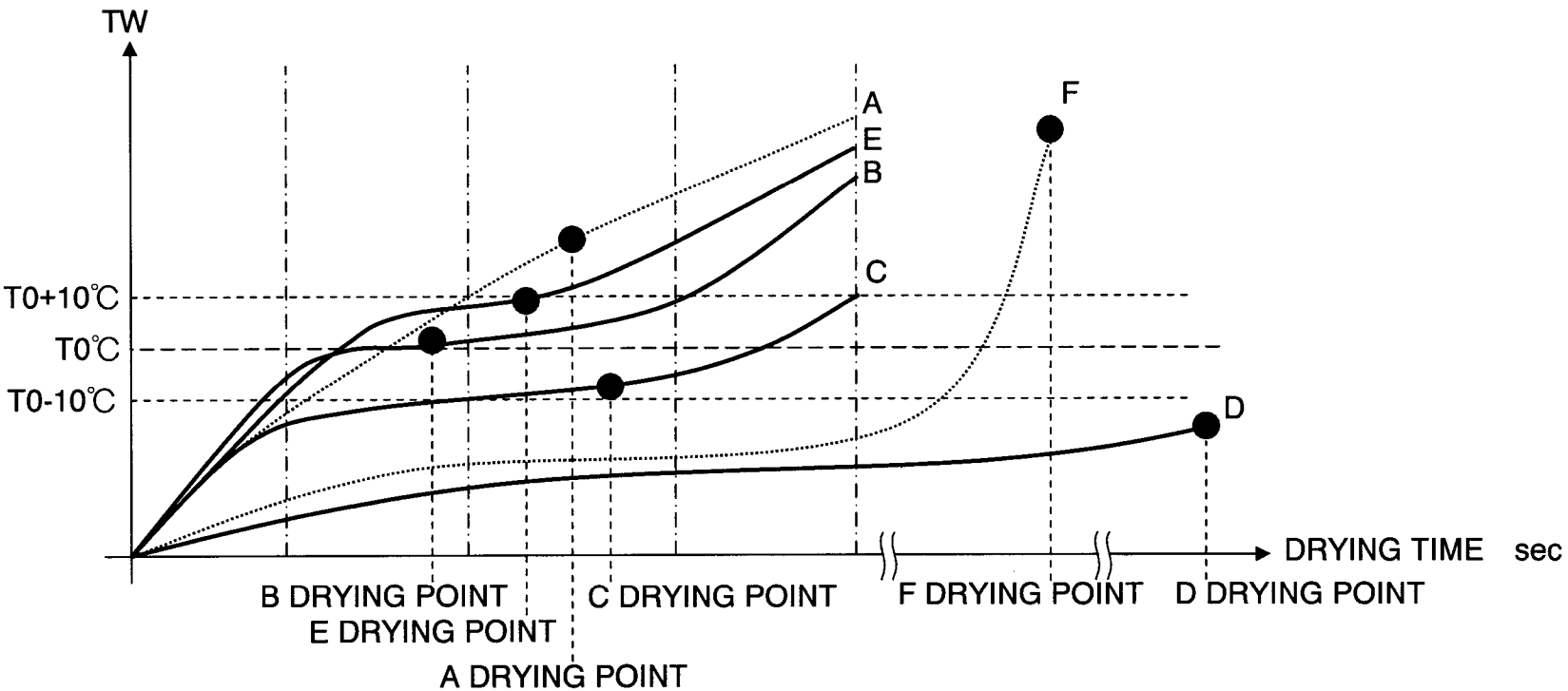
FIG. 2 is a graph that shows a relationship between temperature change of a support and time when a photosensitive layer A is used.

FIG. 2 shows a relationship between change in the temperature (Tw) of the support and time within the second dryer when the photosensitive layer A was used. In this graph, the coating liquid of the second coater was applied onto the lower layer to form the upper layer without raising the temperature of the coating liquid of the second coater. An ordinate designates the temperature of the support and an abscissa designates the time. Experiments were performed by varying the speed of a web, the temperature of drying hot air and the air velocity from a time when the upper layer is applied to a time when the moisture content of the upper layer reaches the drying point, and further by varying presence of temperature control from the rear surface of the support and presence of cooling.

In a pattern A, the upper layer was dried only using hot drying air until the moisture content of the upper layer reached the drying point. At the drying point, the temperature (Tw) of the support was raised to a temperature of not less than the average softening temperature (T0) of the lower layer+10° C. Subsequently, the temperature (Tw) of the support was raised to remove the remaining moisture.

In a pattern B, the temperature (Tw) of the support was raised to the vicinity of the average softening temperature (T0) of the lower layer−10° C. to (T0) in the first drying zone. While hot drying air was applied from above until the moisture content of the upper layer reached the drying point, the support was cooled on the rear surface thereof to maintain the temperature thereof. As a result, the highest temperature of the temperature (Tw) of the support until the drying point was approximately the average softening temperature (T0) of the lower layer. Subsequently, the temperature (Tw) of the support was raised to remove the remaining moisture.

In a pattern C, only using drying air having a moderate temperature, the temperature (Tw) of the support was raised to the range from the average softening temperature (T0) of the lower layer−10° C. to (T0), and maintained until the drying point. As a result, the highest temperature of the temperature (Tw) of the support until the drying point was approximately the average softening temperature (T0) of the lower layer−10° C. to (T0). Subsequently, the temperature (Tw) of the support was raised to remove the remaining moisture.

In a pattern D, the upper layer was dried by hot air having a lower temperature so that the temperature (Tw) of the support might reach the average softening temperature (T0) of the lower layer until the drying point, and the web was traveled at a low speed. As a result, the highest temperature of the temperature (Tw) of the support until the drying point was less than the average softening temperature (T0) of the lower layer−10° C. Subsequently, the temperature (Tw) of the support was raised to remove the remaining moisture.

In a pattern E, the temperature (Tw) of the support was raised to the average softening temperature (T0) of the lower layer−10° C. to (T0)+10° C. in the first drying zone. While applying hot drying air from above until the drying point, the temperature of the support was controlled from the rear surface thereof to maintain the temperature thereof. As a result, the highest temperature of the temperature (Tw) of the support until the drying point was less than the average softening temperature (T0) of the lower layer to (T0)+10° C. Subsequently, the temperature (Tw) of the support was raised to remove the remaining moisture.

In a pattern F, the upper layer was dried so that the temperature (Tw) of the support might reach the temperature far lower than the average softening temperature (T0) of the lower layer−10° C. Subsequently, the temperature was raised before the moisture content of the upper layer reached the drying point. At the drying point, the temperature (Tw) of the support was raised to the temperature of not less than the average softening temperature (T0) of the lower layer+10° C.

In Example 5, only drying air having a comparatively low temperature was applied to the front surface of the support until the moisture content of the upper layer reached the drying point, and the upper layer was dried for a long time. In Example 6, the upper layer was dried from the upper surface of the support comparatively in a short time only using drying air having a moderate temperature until the moisture content of the upper layer reached the drying point. In Example 7, until the moisture content of the upper layer reached the drying point, hot drying air was applied from the upper surface of the support, and the support was cooled on the rear surface thereof. The upper layer was dried in a short time. In Comparative Example 4, until the moisture content of the upper layer reached the drying point, hot drying air was applied from the upper surface of the support, and the temperature of the support was controlled from the rear surface thereof. The upper layer was dried in a short time. In Comparative Example 3, only hot drying air was applied from the upper surface of the support until the moisture content of the upper layer reached the drying point, and the upper layer was dried in a short time.

Figure 3:
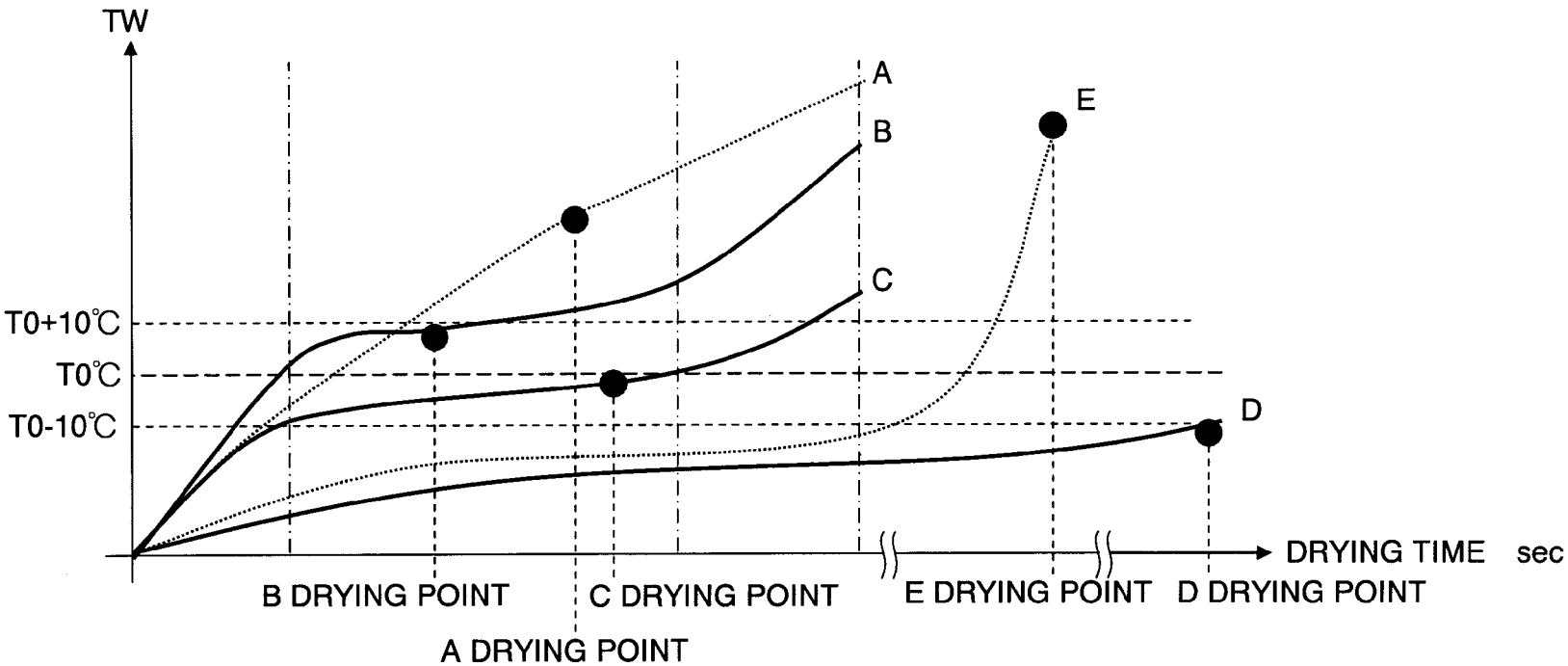
FIG. 3 is a graph that shows a relationship between temperature change of a support and time when a photosensitive layer B is used.

FIG. 3 shows a relationship between change in the temperature (Tw) of the support and time within the second dryer when the photosensitive layer B was used. In this graph, the coating liquid was applied onto the lower layer to form the upper layer without raising the temperature of the coating liquid of the second coater. An ordinate designates the temperature of the support and an abscissa designates the time. Experiments were performed by varying the speed of a web, the temperature of drying hot air and the air velocity from a time when the upper layer is applied to a time when the moisture content of the upper layer reaches the drying point, and further by varying presence of temperature control from the rear surface of the support and presence of cooling.

In a pattern A, the upper layer was dried only using hot drying air until the moisture content of the upper layer reached the drying point. At the drying point, the temperature (Tw) of the support was raised to the temperature of not less than the average softening temperature (T0) of the lower layer+10° C. Subsequently, the temperature (Tw) of the support was raised to remove the remaining moisture.

In a pattern B, the temperature (Tw) of the support was raised in the first drying zone to the average softening temperature (T0) of the lower layer−10° C. to the vicinity of (T0). Until the drying point, while hot drying air was applied from above and the support was cooled on the rear surface thereof to maintain the temperature thereof. As a result, the highest temperature of the temperature (Tw) of the support until the drying point was approximately the average softening temperature (T0) of the lower layer. Subsequently, the temperature (Tw) of the support was raised to remove the remaining moisture.

In a pattern C, only using drying air having a moderate temperature, the temperature (Tw) of the support was raised to the range of the average softening temperature (T0) of the lower layer−10° C. to (T0), and was maintained until the drying point. As a result, the highest temperature of the temperature (Tw) of the support until the drying point was approximately the average softening temperature (T0) of the lower layer−10° C. to (T0). Subsequently, the temperature (Tw) of the support was raised to remove the remaining moisture.

In a pattern D, the upper layer was dried by hot air having a lower temperature so that the temperature (Tw) of the support might reach the average softening temperature (T0) of the lower layer until the moisture content of the upper layer reached the drying point, and the web was traveled at a low speed. As a result, the highest temperature of the temperature (Tw) of the support until the drying point was less than the average softening temperature (T0) of the lower layer−10° C. Subsequently, the temperature (Tw) of the support was raised to remove the remaining moisture.

In a pattern E, the upper layer was dried only using hot drying air until the moisture content of the upper layer reached the drying point. At the drying point, the temperature (Tw) of the support was raised to not less than the average softening temperature (T0) of the lower layer+10° C. Subsequently, the temperature (Tw) of the support was raised to remove the remaining moisture.

In a pattern E, the upper layer was dried so that the temperature (Tw) of the support might reach the temperature far lower than the average softening temperature (T0) of the lower layer−10° C. Subsequently, the temperature of the support was raised before reaching the drying point. At the drying point, the temperature (Tw) of the support was raised to not less than the average softening temperature (T0) of the lower layer+10° C.

[Printing Evaluation Condition]

Evaluation was made wherein an ink concentration of 100 to 90% as a reference was excellent, an ink concentration of 90% to 75% was good, and an ink concentration not more than 75% was poor.

1. print speed: 200 rpm
2. the number of sheets printed: to 2000 sheets
3. ink: Toyo Vantean Eco red
4. dampening water: Toyo Alky 1%

[Results of Printing Evaluation]

In Examples 1 to 4, the highest temperature of the temperature (Tw) of the support until the drying point was not more than the average softening temperature of the lower layer (T0)+10° C. For that reason, all the obtained printing performance evaluations were good or better than that. Example 3 has a shorter time until the moisture content of the upper layer reached the drying point and has excellent productivity by applying hot drying air from the front surface of the support and cooling the support from the rear surface side. On the other hand, since the temperature (Tw) of the support exceeded the average softening temperature (T0) of the lower layer+10° C. in Comparative Examples 1 and 2, all the printing performance evaluations were poor.

Similarly, in Examples 5 to 7, the temperature (Tw) of the support was not more than the average softening temperature of the lower layer (T0)+10° C. For that reason, all the obtained printing performance evaluations were good or better than that. Among them, similarly to the case of Example 3, the Example 7 has a shorter time until the moisture content of the upper layer reached the drying point and has excellent productivity by applying hot drying air from the front surface of the support and cooling the support from the rear surface side. On the other hand, since the temperature (Tw) of the support exceeded the average softening temperature (T0) of the lower layer+10° C. in Comparative Examples 3 and 4, all the printing performance evaluations were poor.

Apparently from the table, in Examples 1 to 7, it can be understood that the time from application to the drying point is shorter when the temperature (Tw) of the support is raised from the average softening temperature (T0) of the lower layer in the range in which the temperature (Tw) may not exceed the average softening temperature (T0) of the lower layer+10° C.

In FIGS. 2 and 3, when performing the application and drying process of the web at a high speed, it is preferable to perform the process based on Examples corresponding to the patterns B and C.

In the patterns B and C, the temperature (Tw) of the support is raised higher than T0−10° C. in the zone in which the support is heated on both the front and rear surfaces thereof. Thereby, drying in a shorter time is allowed and a smaller configuration of the dryer is enabled. In the pattern B, the temperature (Tw) of the support is raised in the range of T0° C. to T0+10° C. in the zone in which the support is heated on both the front and rear surfaces thereof. Thereby, the moisture content of the upper layer reaches the drying point in the shortest drying time, and the printing performance evaluation is also maintained. Furthermore, in both of the patterns, the temperature (Tw) of the support is maintained at the temperature of not more than T0+10° C. while performing temperature control and cooling of the rear surface of the support. Then, after the moisture content of the upper layer reaches the drying point, the support is heated on both the front and rear surfaces thereof, and the temperature is raised to the temperature exceeding T0+10° C. Thereby, drying is completed in a shorter time, and the printing performance evaluation is maintained.

A pattern name closest to the pattern among the patterns A to F shown in the graph of FIG. 2 and the patterns A to E shown in the graph of FIG. 3 was filled into an item of the relationship between the support temperature and the time in the table of FIG. 4. In Examples 1 to 4, it can be easily understood that the patterns B to E of FIG. 2 can prevent inter-layer mixing. Moreover, in Examples 5 to 7, it can be easily understood that the patterns B to D of FIG. 3 can prevent inter-layer mixing.

What is claimed is:

1. A coating method of forming a plurality of layers on a support continuously traveling, comprising:

a step of applying a first coating liquid onto a front surface of the support to form a lower layer on the support;

a drying step of removing a solvent in the lower layer until an amount of the residual solvent reaches not more than 100 mg/m$^2$;

a step of applying a second coating liquid onto the lower layer after drying to form an upper layer; and a drying step of removing moisture of the upper layer; wherein the drying step of removing moisture of the upper layer comprises:

a first drying step of removing moisture in the upper layer until a moisture content of the upper layer reaches not more than 10% of moisture at the time of application within a range in which a following conditional expression (1) is satisfied:

(1) temperature (Tw) of the support≦average softening temperature (T0) of the lower layer+10° C.; and a second drying step of raising the temperature (Tw) of the support to remove remaining moisture of the upper layer, wherein in the second drying step, the support is heated on both front and rear surfaces of the support, and the temperature (Tw) of the support is raised to a temperature of not less than the average softening temperature (T0) of the lower layer+10° C. to remove the remaining moisture of the upper layer.

2. A coating method of forming a plurality of layers on a support continuously traveling, comprising:

a step of applying a first coating liquid onto a front surface of the support to form a lower layer on the support;

a drying step of removing a solvent in the lower layer until an amount of the residual solvent reaches not more than 100 mg/m$^2$;

a step of applying a second coating liquid onto the lower layer after drying to form an upper layer; and a drying step of removing moisture of the upper layer; wherein the drying step of removing moisture of the upper layer comprises:

a first drying step of removing moisture in the upper layer until a moisture content of the upper layer reaches not more than 10% of moisture at the time of application within a range in which a following conditional expression (1) is satisfied:

(1) temperature (Tw) of the support≦average softening temperature (T0) of the lower layer+10° C.; and a second drying step of raising the temperature (Tw) of the support to remove remaining moisture of the upper layer, wherein in the first drying step, the support is heated on the both the front and rear surfaces of the support until the temperature (Tw) of the support reaches the average softening temperature (T0) of the lower layer−10° C. to (T0)+10° C., and subsequently the support is heated on the front surface of the support while heating on the rear surface of the support is controlled.

3. The coating method according to claim 1, wherein in the first drying step, the support is heated on the both the front and rear surfaces of the support until the temperature (Tw) of the support reaches the average softening temperature (T0) of the lower layer−10° C. to (T0)+10° C., and subsequently the support is heated on the front surface of the support while heating on the rear surface of the support is controlled.

4. A coating method of forming a plurality of layers on a support continuously traveling, comprising:

a step of applying a first coating liquid onto a front surface of the support to form a lower layer on the support;

a drying step of removing a solvent in the lower layer until an amount of the residual solvent reaches not more than 100 $mg/m^2$;

a step of applying a second coating liquid onto the lower layer after drying to form an upper layer; and a drying step of removing moisture of the upper layer; wherein the drying step of removing moisture of the upper layer comprises:

a first drying step of removing moisture in the upper layer until a moisture content of the upper layer reaches not more than 10% of moisture at the time of application within a range in which a following conditional expression (1) is satisfied:

(1) temperature (Tw) of the support≦average softening temperature (T0) of the lower layer+10° C.; and a second drying step of raising the temperature (Tw) of the support to remove remaining moisture of the upper layer, wherein in the first drying step, the support is heated on the both the front and rear surfaces of the support until the temperature (Tw) of the support reaches the average softening temperature (T0) of the lower layer−10° C. to (T0)+10° C., and subsequently the support is heated on the front surface of the support while being cooled on the rear surface of the support.

5. The coating method according to claim 1, wherein in the first drying step, the support is heated on the both the front and rear surfaces of the support until the temperature (Tw) of the support reaches the average softening temperature (T0) of the lower layer−10° C. to (T0)+10° C., and subsequently the support is heated on the front surface of the support while being cooled on the rear surface of the support.

6. A method for manufacturing a planographic printing plate having a photosensitive layer and a protective layer in this order on a support, wherein the photosensitive layer is applied as a lower layer and the protective layer is applied as an upper layer by the coating method according to claim 1.

7. A method for manufacturing a planographic printing plate having a photosensitive layer and a protective layer in this order on a support, wherein the photosensitive layer is applied as a lower layer and the protective layer is applied as an upper layer by the coating method according to claim 2.

8. A method for manufacturing a planographic printing plate having a photosensitive layer and a protective layer in this order on a support, wherein the photosensitive layer is applied as a lower layer and the protective layer is applied as an upper layer by the coating method according to claim 3.

9. A method for manufacturing a planographic printing plate having a photosensitive layer and a protective layer in this order on a support, wherein the photosensitive layer is applied as a lower layer and the protective layer is applied as an upper layer by the coating method according to claim 4.

10. A method for manufacturing a planographic printing plate having a photosensitive layer and a protective layer in this order on a support, wherein the photosensitive layer is applied as a lower layer and the protective layer is applied as an upper layer by the coating method according to claim 5.

* * * * *